United States Patent [19]

Culbertson

[11] Patent Number: 4,752,056

[45] Date of Patent: Jun. 21, 1988

[54] FLOOR PROTECTOR FOR APPLIANCE LEVELING LEG

[76] Inventor: Lonnie W. Culbertson, 4132 W. El Camino Dr., Phoenix, Ariz. 85051

[21] Appl. No.: 50,151

[22] Filed: May 14, 1987

[51] Int. Cl.[4] ..... A47B 91/00

[52] U.S. Cl. ..... 248/188.9; 248/346.1

[58] Field of Search ..... 248/677, 188.4, 188.9, 248/346.1, 359, 360; 411/337, 371–377

[56] References Cited

U.S. PATENT DOCUMENTS

| | | | |
|---|---|---|---|
| 340,430 | 4/1886 | Donnelly | 248/346.1 |
| 342,970 | 6/1886 | Ongley | 248/346.1 |
| 807,535 | 12/1905 | Beardsley | 248/188.9 |
| 821,225 | 5/1906 | Dozier | 248/188.4 |
| 1,430,341 | 9/1922 | Walsh | 248/346.1 |
| 1,480,758 | 1/1924 | Hight | 248/346.1 |
| 1,520,534 | 12/1924 | Cruver | 411/375 |
| 1,562,817 | 11/1925 | Wismer | 248/346.1 |
| 1,730,698 | 10/1929 | Wagner | 248/346.1 |
| 1,887,283 | 11/1932 | Brabson | 248/346.1 |
| 2,379,296 | 6/1945 | Harbert | 411/337 |
| 2,890,545 | 6/1959 | Fiddler | 248/188.4 |
| 4,504,180 | 3/1985 | Ishii | 411/373 |

FOREIGN PATENT DOCUMENTS

| | | | |
|---|---|---|---|
| 1058460 | 11/1953 | France | 411/373 |

*Primary Examiner*—J. Franklin Foss
*Assistant Examiner*—Robert A. Olson
*Attorney, Agent, or Firm*—Wm. H. Drummond

[57] ABSTRACT

A floor protector for appliance leveling legs includes a shallow dish-shaped bearing plate having a floor-contacting area substantially larger than the end of the leveling leg. The major portion of the periphery of the bearing plate is upwardly curved. A bolt head-retaining clip, the outer end of which is affixed to the bearing plate, has a notched inner end spaced above the bearing plate. The "bolt head" end of the leveling leg is received and retained between the bearing plate and the retaining clip. A notch in the inner end of the clip is wide enough to receive and transversly locate the vertical shaft portion of the leveling leg.

1 Claim, 1 Drawing Sheet

FLOOR PROTECTOR FOR APPLIANCE LEVELING LEG

This invention relates to a device for preventing damage to floors by the leveling legs of appliances.

More particularly, the invention pertains to a floor protector for appliance leveling legs which is semi-permanently installed on the bottom of a threaded leveling leg.

In yet another respect, the invention relates to such a floor protector which substantially prevents damage to floors when the appliance is slid across the floor without lifting it.

In yet another and more particular aspect, the invention concerns such a floor protector which remains semi-permanently affixed to the bottom of a leveling leg during movement of the appliance, whether or not it is lifted above the floor.

A wide variety of relatively heavy machines such as household appliances, vending machines and the like must be leveled when installed in order for the machines to function properly. To facilitate leveling, most such machines are provided with one or more so-called "leveling legs". Such legs typically comprise a vertical threaded shaft portion which engages mating threads formed in the understructure of the machine. The lower end of the threaded shaft terminates in a flattened "bolt head" portion which provides a floor-bearing surface somewhat larger than the end of the vertical shaft. Typically, the head end of the shaft is hexagonally shaped or otherwise shaped to facilitate turning the shaft with a wrench to facilitate raising or lowering the shaft and leveling the machine.

Commonly, however, the undersurface of the bolt head presents such a relatively small floor-bearing area that it is difficult to move the machine by sliding it across the floor (without lifting the machine) without damaging the floor surface, particularly floor surfaces composed of vinyl tile, linoleum and the like. This probelm is exacerbated by the fact that the bolt heads often present sharp floor-contacting edges which dig into a soft floor covering or scratch a hard floor surface. Furthermore, even if the machine is not moved, over a period of time the concentrated distribution of the weight of the machine on the relatively small floor-bearing surface of the leveling leg causes depression of a soft floor surface, leaving permanent marks and otherwise presenting an unsightly appearance if the machine is relocated.

Prior workers have recognized this general problem and have provided a variety of caster cups, leg rests and other devices to attempt a resolution of these problems. While such prior devices provide partial solutions to these problems, in general they are not specifically adaptable for use in connection with typical leveling legs. In particular, repositioning of such prior art devices must be accomplished each time the machine is moved for cleaning, etc., because the devices are not semi-permanently attached to the leveling legs, themselves, but are merely inserted between the appliance legs and the floor. Representative examples of such prior devices include those disclosed in U.S. Pat. Nos. 340,430 to Donnelly, 342,970 to Ongley, 1,730,698 to Wagner and 1,887,283 to Brabson.

It would be highly desirable to provide a floor protector especially adapted for use in connection with leveling legs for appliances and the like in which the leveling leg consists of a rotatable threaded vertical shaft which engages mating threads on the understructure of an appliance and in which the lower terminal portion of the vertical shaft is formed into a bolt head of substantial thickness and a surface area somewhat larger than the cross-sectional area of the vertical shaft.

It would be highly desirable to provide a floor protector for use in connection with such leveling legs which would be semi-permanently attachable to the terminal lower end of the leveling leg such that the protector would remain in place even though the appliance is moved or slid across the floor without lifting the appliance or in the event the entire appliance is lifted above the floor.

It would also be highly desirable to provide such a protector which is specially shaped to prevent presenting exposed sharp edges to a floor surface when the appliance is slid across the floor.

Accordingly, the principal object of the present invention is to provide an improved floor protector for appliance leveling legs.

Yet another object of the invention is to provide such a protector which remains semi-permanently attached to a leveling leg such that the appliance can be slid or lifted from the floor without dislodging the protector.

Yet another object of the invention is to provide a floor protector which does not present sharp edges to the floor surface.

Still another object of the invention is to provide such a floor protector which will distribute the weight of the appliance over a significantly greater surface area than that provided by the floor-bearing surface of the leveling leg.

These and other, further and more specific objects and advantages of the invention will be apparent to those skilled in the art from the following detailed description, taken in conjunction with the drawings, in which.

Figure 1:
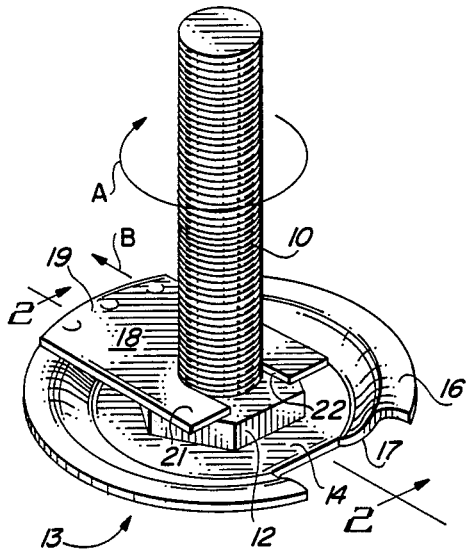
FIG. 1 is a perspective view of a typical appliance leveling leg of the prior art, shown with the floor protector semi-permanently attached thereto.
Figure 2:
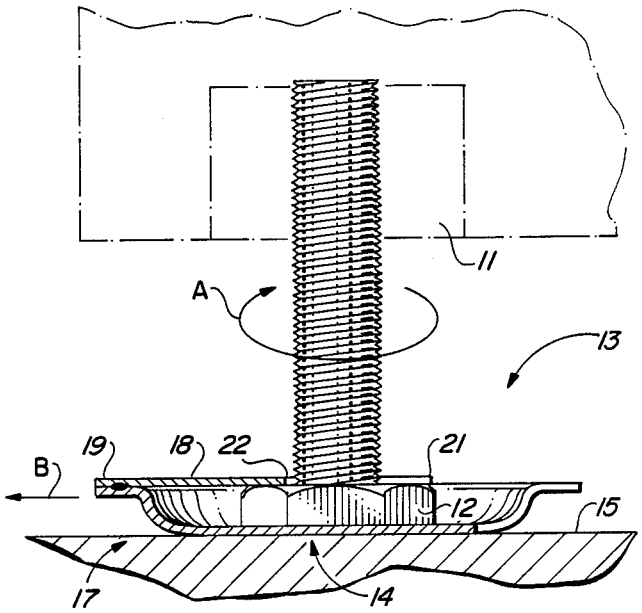
FIG. 2 is a sectional view of the leveling leg-protector defice of FIG. 1 taken along section line 2—2 thereof.
Figure 3:
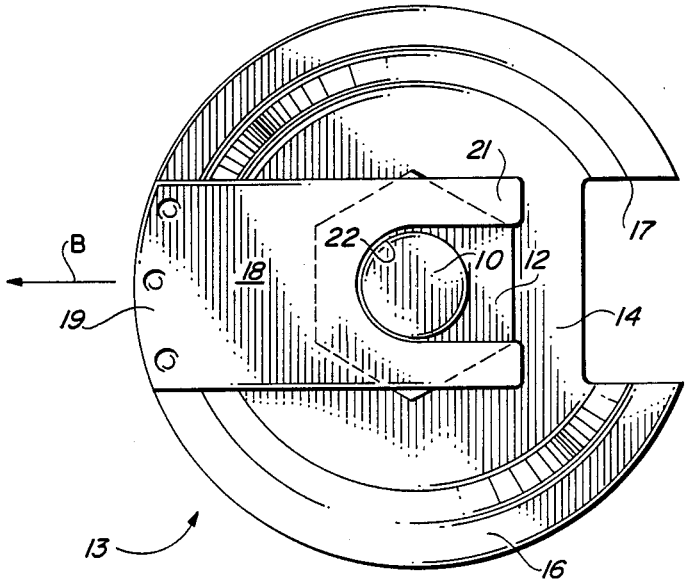
FIG. 3 is a plan view of the lower end of the leveling leg with attached protector as shown in FIGS. 2-3.

Briefly, in accordance with the invention, I provide a protector to prevent damage to floors by the leveling legs of appliances. Such leveling legs include a rotatable vertical threaded shaft portion which engages mating threads formed in the understructure of said appliance. The threaded shaft portion terminates at its lower end in a floor-contacting bolt head formed integrally therewith. Rotation of the shaft provides adjustment of the vertical position of the head to permit leveling the appliance.

The protector of the invention comprises a shallow, dish-shaped bearing plate, having a floor-contacting area substantially larger than the bolt head. The major periphery of the bearing plate is upwardly curved at its edges proximate the floor-contacting area. A bolt head-retaining clip is provided, the outer end of which is affixed to the bearing plate and the inner end thereof is notched and spaced above the bearing plate a distance sufficient to permit the bolt head to be received and retained between the bearing plate and the retaining clip. The notch on the inner end of the retaining clip is sized to receive and transversely locate the upwardly extending shaft portion of the leveling leg.

In the drawings, in which the presently preferred embodiment of the invention is depicted for purposes of illustration and not by way of limitation on the scope of the invention, like reference numerals depict the same elements in the several views. The leveling legs with which the invention is useful generally comprise a threaded rotatable vertical shaft 10, the threads of which mate with and engage threads formed in the understructure 11 of an appliance. A bolt head 12, which normally contacts the floor, is formed integrally on the lower end of the shaft portion 10. Rotation of the shaft as indicated by the arrow A causes the shaft 10 to advance or retract from the threaded understructure 11 of the appliance to permit leveling the appliance.

The protector comprises a shallow, dish-shaped bearing plate, generally indicated by reference numeral 13, having a floor-contacting area 14 which is substantially larger than the bearing area of the bolt head 12. This distributes the weight of the appliance over a larger area resulting in a lower pressure per unit area on the floor surface 15. The periphery 16 of the bearing plate 13 is curved upwardly (as shown at 17) proximate the floor-contacting area 14. A bolt head-retaining clip 18 has an outer end 19 which is affixed to the bearing plate 13, e.g., by spot welding. The inner end 21 is notched and spaced above the bearing plate 13 a distance sufficient to permit the bolt head 12 to be received and retained between the bearing plate 13 and the clip 18. The notch 22 is sized to receive and transversely locate the upwardly extending shaft portion 10.

As will be observed, the protector is semi-permanently affixed to the lower end of the leveling legs such that it remains in place even though the appliance is lifted off the floor or even when the appliance is slid across the floor, e.g., in the direction of the arrow B.

As used herein, the term "appliance" is intended to include not only normal domestic household appliances such as stoves, refrigerators, washing machines, and the like, but also commercial machines such as vending machines, game machines, etc.

Having described my invention in such terms as to enable those skilled in the art to understand and practice it, and having identified the presently preferred embodiments thereof, I claim:

1. In combination with a leveling leg for an appliance, said leveling leg comprising a rotatable vertical threaded shaft portion which engages mating threads formed in the understructure of said appliance and a floor-contacting bolt head formed integrally on the bottom of said shaft portion, rotation of said shaft providing adjustment of the vertical position of said floor-contacting head to permit leveling of said appliance, a floor protector, including (a) a shallow dish-shaped bearing plate, having a flat bolt head supporting upper surface and a floor-contacting undersurface area substantially larger than said bolt head, the major periphery of which is upwardly curved proximate the floor-contacting area, and (b) a bolt head-retaining clip having an outer end affixed to said bearing plate and a notched inner end spaced above said bearing plate a distance sufficient to permit said bolt head to be received and retained between said bearing plate and said retaining clip, the notch in said inner end being sized to receive and transversely locate said upwardly extending shaft portion.

* * * * *